US009885143B2

(12) United States Patent
Grunert

(10) Patent No.: US 9,885,143 B2
(45) Date of Patent: Feb. 6, 2018

(54) LAUNDRY DRYING DEVICE AND METHOD FOR CLEANING A FILTER

(75) Inventor: Klaus Grunert, Berlin (DE)

(73) Assignee: BSH Hausgeräte GmbH, Munich (DE)

( * ) Notice: Subject to any disclaimer, the term of this patent is extended or adjusted under 35 U.S.C. 154(b) by 1277 days.

(21) Appl. No.: 12/639,062

(22) Filed: Dec. 16, 2009

(65) Prior Publication Data

US 2010/0154240 A1 Jun. 24, 2010

(30) Foreign Application Priority Data

Dec. 22, 2008 (DE) ..... 10 2008 055 086

(51) Int. Cl.
*D06F 58/22* (2006.01)

(52) U.S. Cl.
CPC ..... *D06F 58/22* (2013.01)

(58) Field of Classification Search
CPC ..... D06F 58/22; B01D 46/0042; B01D 46/04
USPC ..... 34/467, 480, 72, 82, 85; 95/281; 96/233
See application file for complete search history.

(56) References Cited

U.S. PATENT DOCUMENTS 3,563,474 A * 2/1971 Robinson ..... 239/561
3,978,592 A * 9/1976 Schuurink ..... 34/82
4,938,787 A * 7/1990 Simmerlein-Erlbacher ... 96/298
6,966,126 B2 * 11/2005 Baurmann ..... 34/606
2006/0123854 A1 6/2006 Hong et al.
2007/0107251 A1 5/2007 Goldberg et al.
2007/0108181 A1 5/2007 Gassmann et al.

FOREIGN PATENT DOCUMENTS

| | | | |
|---|---|---|---|
| DE | 3600058 | A1 * | 7/1987 |
| DE | 42 12 965 | A1 | 10/1993 |
| DE | 100 02 743 | A1 | 8/2001 |
| EP | 0 269 864 | A1 | 6/1988 |
| EP | 0 443 361 | A1 | 8/1991 |
| EP | 816549 | A2 * | 1/1998 |
| JP | 06002907 | A * | 1/1994 |
| JP | 2003340197 | A * | 12/2003 |
| JP | 2006-187449 | A | 7/2006 |
| KR | 10-2007-0076853 | | 7/2007 |
| WO | 2009/015919 | A1 | 2/2009 |

OTHER PUBLICATIONS

Nov. 3, 2015 European Search Report issued in European Patent Application No. 09178896.8 (in German).

* cited by examiner

*Primary Examiner* — Jessica Yuen
(74) *Attorney, Agent, or Firm* — Nixon & Vanderhye P.C.

(57) ABSTRACT

A laundry dryer includes a stationary filter for filtering-out fluff from a process air stream flowing through a process air channel of the laundry dryer, the filter in a compartment inclined at an angle relative to a through-flowing process air stream and including a cleaning opening in an upper region of the filter for directing cleaning liquid onto a filter surface of the filter, and a cleaning device for cleaning of the filter.

31 Claims, 2 Drawing Sheets

LAUNDRY DRYING DEVICE AND METHOD FOR CLEANING A FILTER

BACKGROUND OF THE INVENTION

The invention relates to a laundry dryer and a method for cleaning of a filter of a laundry dryer.

In laundry dryers such as tumble dryers or washer-dryers, the use of filters for cleaning the process air is known. In tumble dryers such a filter is arranged as a fluff filter in a process air channel leading away from the drum housing. When laundry is dried in a laundry drum within the drum housing, matter, in particular fluff, is extracted from the laundry with the process air as the process medium, and carried away with the process air in the process air channel. The filter serves to filter such fluff out of the process air, so that the fluff is not able to reach a condenser for drying of the process air and become deposited thereupon. This would impair an efficiency level of the condenser. Until now it has been possible to remove filters of this type and then manually clean them, in order to remove fluff adhering to the filter.

A dryer for drying laundry by means of a stream of air is known from patent specifications EP 1 788 140 A1, EP 1 788 141 A2 and EP 1 788 141 A2. A filter for filtering fluff out of a stream of air in the process air guide is arranged in the dryer in the region of an end plate, which filter forms a first fluff filter. By means of a scraper, fluff collecting on the filter in the process air guide is wiped off the filter fabric of the fluff filter and stored in a container arranged adjacent to the scraper and the filter. The scraper and the container thus form, together with further components, a first cleaning device. The container is, though, relatively small in dimensions, as a result of the constructional space available in the region of the scraper. The fluff from around 7 to 10 drying processes can be collected therein. As the fluff is stored in a dry state, it takes up a relatively large volume. On the one hand in the case of this dryer accessibility to the collecting container is limited, and on the other hand the collecting volume is restricted through its arrangement in a zone of the dryer which is of limited dimensions, giving rise to a relatively frequent maintenance interval for disposal of the fluff from the container. The dryer furthermore has a heater as a heat source and an air-to-air heat exchanger as a heat sink in the process air guide.

US 2006/0123854 A1 relates to a washing machine, which is combined with a dryer. A housing is provided for in the washing machine, a trough is built into the housing, a venting hose is attached to an outer surface of the trough, a fluff filter arrangement has an end connected with the venting hose, in order to remove fluff from the air, which is emitted from the trough, and a venting line is connected with the other end of the fluff filter arrangement. The fluff filter arrangement collects fluff from the through-flowing moist air. The collected fluff is deposited on a filter of the fluff filter arrangement, and the deposit of fluff is removed by means of the injection of water from a water inlet line onto the filter from the front. The removed fluff is directed through the venting hose into the trough. The fluff filter arrangement built into the housing is inclined at a predetermined angle in the direction of the front of the washing machine, so that a user can easily remove the filter unit from the front of the washing machine and can repair the fluff filter arrangement.

WO 2009/015919 A1 relates to an arrangement for the automatic cleaning of air filters, in particular of such as are designed for use in applications such as the drying circuit of a washing machine for clothing, which works according to a heat pump principle, having at least one sharp-stream injection nozzle for the injection of fluid and at least one air filter unit, wherein the liquid injection nozzle is arranged in such a way that it is a position to move relative to a fixed frame, wherein the relative movement is brought about by means of at least one actuator means connected therewith. The air filter unit and/or the liquid injection nozzle can be connected with the frame by means of a four-bar linkage. Cleaning here presupposes the movement of the air filter unit relative to the injection nozzle, necessitating a high degree of equipment-related effort and large space requirements.

BRIEF SUMMARY OF THE INVENTION

It is an object of the present invention to provide a possibility for the particularly efficient cleaning of a filter, in particular fluff filter, in a laundry dryer.

A laundry dryer in accordance with an exemplary embodiment of the present invention has a filter for the filtering-out of matter, in particular fluff, from a process air stream flowing through a process air channel, as well as a cleaning device for cleaning of the filter. Such a filter can be cleared of deposited fluff in a simple manner without manual intervention on the part of the user of the home appliance, by means of an automatically operated cleaning device, which rinses cleaning liquid over the fluff filter in such a way that the adhering fluff is removed from a filter surface of the filter. The filter is arranged in the compartment inclined at an angle relative to the through-flowing process air stream. Cleaning liquid, e.g. water, applied to the filter can drain away autonomously and thereby carry fluff etc. with it. Accordingly, the cleaning liquid does not need to be applied under high pressure, which saves both cost and structural space, for example for a pressure device, neither do areas of standing water form, whereby a good cleaning effect is achieved. The application of the cleaning liquid under pressure can, however, further enhance cleaning performance.

The filter is installed in a stationary manner (and is thus not selectively moved for cleaning), in order to achieve a simple arrangement. The effective cleaning effect can in particular be enabled through the arrangement of the cleaning opening in the upper region.

At least one cleaning opening for direction of the cleaning liquid onto a filter surface of the filter can be arranged in an upper region of the filter. The cleaning liquid can thereby be particularly simply applied to the filter surface in a compact structural manner. The arrangement in an upper region can in particular encompass that the cleaning opening is arranged above, in particular essentially directly above the filter. In other words the cleaning opening can essentially directly border the filter. The cleaning liquid can thereby be particularly simply and fully applied to the filter.

For the simple distribution of the cleaning liquid across the width of the filter, at least one cleaning opening can lead to a common liquid line and/or a common inflow chamber of the cleaning device.

For an intensified cleaning effect including in the case of matter firmly adhering to the filter, in particular fluff, the at least one cleaning opening can be embodied as a nozzle. Also, through shaping of the nozzle stream, a wide-area wetting of the filter can thus be ensured. By means of a nozzle, a cleaning liquid can be directed and guided over the filter surface of the filter with increased entertainment force.

To maximize a flow-speed of cleaning liquid onto the filter, the at least one cleaning opening can be oriented flush with the filter surface of the filter.

For optimization of the cleaning effect, it can also however be advantageous, if the at least one cleaning opening is oriented at an, in particular small, angle to the filter surface of the filter. The angle is advantageously less than 5°.

The liquid line preferably ends in an inflow chamber, which is partially separated from the at least one cleaning opening via a partition. A more even distribution of the cleaning liquid over a multiplicity of such cleaning openings is thereby achieved. The inflow chamber can have a bypass below for the drainage of residual water, so that such water does not remain standing therein and cause unpleasant odors over time.

To dispose of cleaning liquid directed over the filter, a drain channel can be embodied in a lower region of the filter. This preferably circumvents the condenser and behind the condenser once again leads into the process air channel. Used cleaning liquid can thus be disposed of together with condensate from the condenser, so that no separate means of disposal needs to be provided.

At least one section of the drain channel bordering the filter can be integrated with the filter. It can thereby be achieved that at the transition from filter to drain channel no projections such as sharp edges, burrs etc. occur, upon which fluff etc. could become snagged. Complete cleaning of the filter can thereby be supported. To this end it can in particular be advantageous if a filter surface of the filter in a transitional area to the drain channel is arranged at a higher level or flush therewith.

The process air channel can, at least in the region of the filter, have an essentially vertical (that is vertical or, for the purpose concerned, only insignificantly divergent therefrom) extension, in particular with a direction of flow of the process air running largely from top to bottom in the process air channel, which is highly flow-favorable and advantageous for drainage of the cleaning liquid.

For simple implementation and compact structure, the cleaning device can be built in to an end plate, in particular a front end plate. In other words the cleaning device can be built into a forward process air channel, which directly abuts a laundry drum, in a particularly compact and flow-favorable manner. Pressure losses in the process air can thereby be prevented, which for example could arise as a result of eddies.

It can be particularly preferable, if the filter is integrated in the cleaning device, as manufacturing tolerances are thereby minimized and thus the cleaning result improved. It is particularly preferable, if the at least one cleaning opening is integrated in a filter frame of the filter. It is also particularly preferable, if the drain channel or a part thereof bordering the filter is integrated in the filter frame.

The filter can be permanently built in or arranged in the laundry dryer in a removable manner.

In the method the filter of a laundry dryer is cleaned by means of a cleaning device, wherein the filter is arranged in the compartment inclined at an angle and a cleaning liquid is advantageously directed from above over the obliquely built-in filter. The directing process can in particular take the form of an essentially unpressurized pouring.

The activation of the method can be automatically triggered by a control device of the home appliance as required, in prescribed, fixed cycles and/or manually.

BRIEF DESCRIPTION OF THE DRAWINGS

In the following figures the invention is described schematically in greater detail on the basis of an exemplary embodiment. For improved clarity, identical elements or those with the same effect are denoted by the same reference characters, wherein.

DETAILED DESCRIPTION OF EXEMPLARY EMBODIMENTS OF THE PRESENT INVENTION

Figure 1:
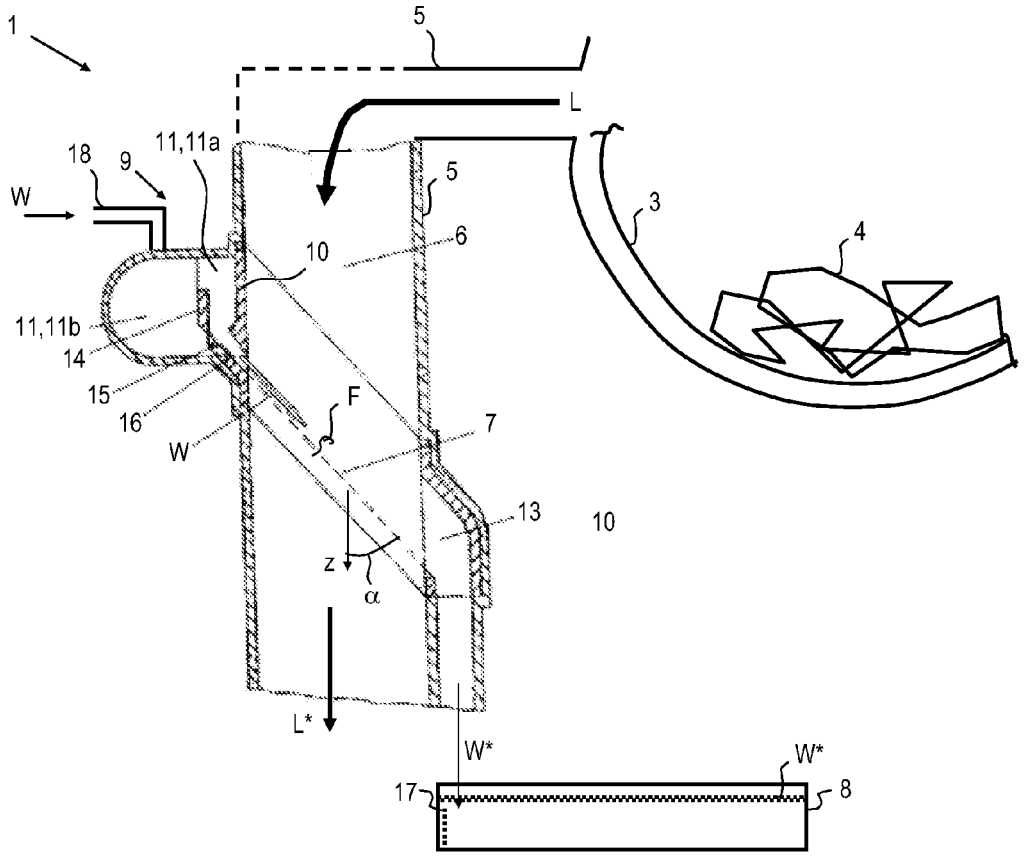
FIG. 1 shows in schematic form and as a partial cutaway view, individual components of a tumble dryer with a filter embodied as a fluff filter and with a cleaning device for cleaning of the filter

FIG. 1 shows components of a laundry dryer 1, such as a tumble dryer or washer-dryer. The laundry dryer 1 has a laundry drum 3, which serves to dry laundry 4 placed therein. During drying of the laundry 4, the process air L located in the laundry drum 3 is humidified, whereby matter F such as fluff reaches the process air L.

The process air L is carried out of the laundry drum 3 via a process air channel 5 connected therewith. In order to filter or separate at least part of the matter F out of the process air, a fluff filter 7 extends through process air channel 5. The process air L passing through the fluff filter 7 is conveyed as cleaned process air L* to further components of the laundry dryer 1. These are, for example, a condenser or a heating device, which serve to dehumidify or heat up the cleaned process air L*, before the cleaned process air L* is once more blown into the laundry drum 3.

In the arrangement represented in FIG. 1 the process air channel 5 runs vertically from top to bottom in the region with the fluff filter 7 installed therein. The fluff filter 7 is mounted therein inclined at an angle $\alpha$ through the process air channel 5. Accordingly it is penetrated by the process air stream flowing through the process air channel 5 at an oblique angle. A fluff filter cleaning device 9, which flushes fresh water W over the fluff filter 7 as the cleaning liquid serves to clean the fluff filter 7.

As a result of the inclined orientation of the fluff filter 7, the cleaning liquid W runs over or along a fluff filter surface of the fluff filter 7 to its lower region. In the lower region, in particular at the lowest-lying point of the fluff filter 7 is attached a drain channel 13, the section of which abutting the fluff filter 7 represents part of a fluff filter housing 10, in particular the filter frame. The drain channel 13 enables the cleaning liquid W*, which has flowed across the fluff filter surface and is thus soiled, to escape. The soiled cleaning liquid W* is directed via a channel 13 for removal to a liquid container 8. The liquid container 8 here takes the form of a condensate container, in which condensate water which is expelled from the condenser is also collected. The cleaning liquid W is fed by a fresh water line 18. For even distribution over the fluff filter surface of the fluff filter 7, the cleaning device 9 has an inflow chamber 11 in the entry area of the liquid line 18. The actual spraying of the cleaning liquid W onto the fluff filter surface of the fluff filter 7 takes place via one or more nozzles 16. To be more precise, the inflow chamber 11 is divided into two dish-like parts by a partition 14 open at the top, wherein a first, inner chamber 11*a* is connected directly with the nozzles 16 and a second, outer chamber 11*b* is flushed by the liquid line 18. Thus during operation, cleaning liquid flows into the outer chamber 11*b* and fills this, where, if the upper edge of the partition 14 is reached, the cleaning liquid then flows into the inner chamber 11*a* and from there reaches the nozzles 16. In order finally to be able to drain the water out of the inflow chamber 11 after the cleaning process by means of the cleaning device 9 or in the event of the laundry dryer 1 being taken out of operation, a bypass is embodied 15 in the lower region of the partition 14. The bypass 15 preferably has a relatively small diameter, via which the residual water can drain.

The starting point is thus assumed that the fluff filter 7 is employed in a process air channel 5 of a washer-dryer or tumble dryer 1. The fluff filter 7 preferably has a surface with a functional coating, in particular a hydrophobic coating, which makes it difficult for matter F to cling firmly thereto. To clean off the matter F collecting on the fluff filter 7, in particular fluff, the cleaning liquid W is rinsed over the fluff filter 7, in order to loosen matter F from the fluff filter surface by means of cleaning liquid W and to convey it away from the fluff filter 7. By means of a reduction in the components for cleaning of the fluff filter, in that the fluff filter itself works as a functional element of the cleaning device 9 through its inclined position within the compartment, the tolerances of the cleaning results are advantageously kept small. The cleaning device 9 for application of the cleaning liquid W is integrated into the fluff filter 7.

The fluff filter material is preferably metal or contains metal. For usage in a damp environment such as in a tumble dryer or a washing machine, the fluff filter material is preferably a corrosion-resistant material, in particular non-corroding material resistant to the effects of washing liquor or water. In particular stainless steel or aluminum which are temperature-resistant can advantageously be employed as the fluff filter material, and if appropriate can simply be hydrophobically coated with a suitable finishing material. It is preferable if such a hydrophobic finish is embodied as a nano lacquer and/or a Lotus Effect acting at or upon the fluff filter material. The fluff filter material with the finish is preferably embodied as a fabric, textile or as a perforated foil or metal sheet.

Advantageously in the case of such an arrangement the removal of the fluff filter 7 by a user of the laundry dryer 1 is no longer required. The ability to remove the fluff filter 7 from the process air channel 5 and the fluff filter-cleaning device 9 is however preferably enabled, in order to afford service engineers access for servicing purposes.

Figure 2:
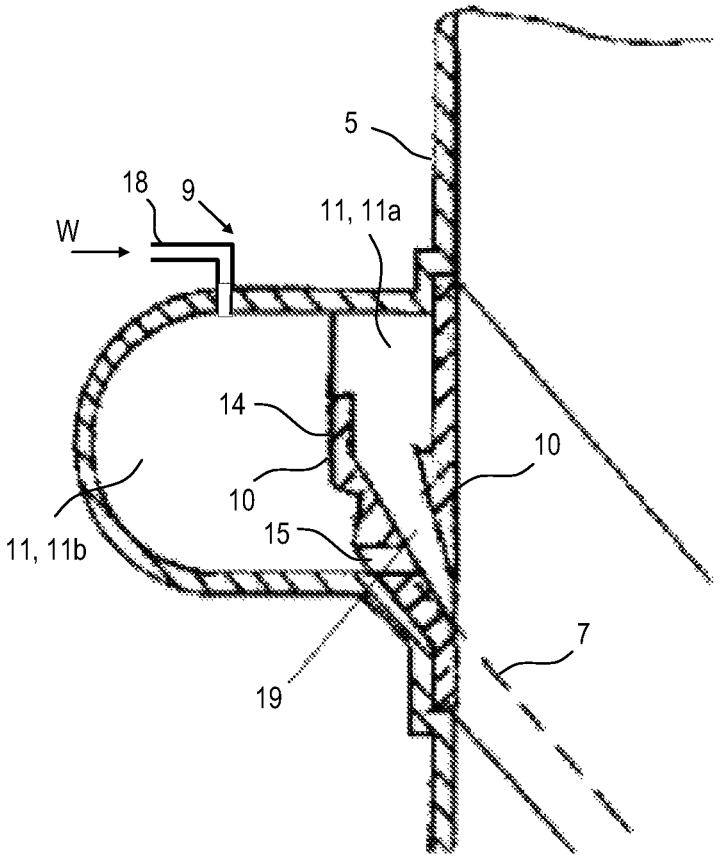
FIG. 2 shows in schematic form a cleaning device modified therewith.

While the nozzle 16, as represented in FIG. 1, for distribution of the cleaning liquid W on or over the fluff filter surface can be oriented flush with the top of the fluff filter fabric of the fluff filter 7, the possibility also exists according to a modified embodiment of setting the nozzle 19, as represented in FIG. 2, at an angle to the fluff filter surface. By means of suitable selection of an inflow angle, the cleaning effect can be optimized, which can in particular also be harmonized in conjunction with an inclination of the fluff filter 7 relative to the surrounding compartment.

Besides a preferably precise and reproducible arrangement of the nozzle 16 for cleaning of the fluff or matter F from the fluff filter 7, the removal of the matter F from the fluff filter 7 by means of the cleaning liquid W preferably also takes place via an outlet in the form of the outflow chamber 12, which is integrated into the fluff filter 7. The embodiment is selected such that in the transitional area between the fluff filter 7 or its surface and an adjacent boundary wall of the outflow chamber 12, no sharp edges, burrs etc. are embodied, on which matter F of this kind can become snagged or stuck fast, which would prevent proper cleaning. As in the case of the nozzle 16, the lower edge of the transport channel or of the outflow chamber 12 is oriented flush with the top of the fluff filter fabric.

Particularly preferably is a flow-favorable arrangement of the cleaning device 9 with the fluff filter 7 and of the channel for removal 13 in the forward process air channel, in particular in the region of the front end plate. Pressure losses in the process air L caused, for example, through eddies, are thereby prevented.

Particularly preferable is an embodiment as in FIG. 1, in which for improvement of the cleaning effect, the nozzle or the nozzles 16 for distribution of the cleaning liquid on the fluff filter 7 are integrated into the fluff filter housing 10 or into a fluff filter frame of the fluff filter 7. It is likewise preferable if for improvement of fluff removal from fluff filter 7, the channel for removal 13 or the outflow chamber 12 is integrated in a lower section of the fluff filter frame of the fluff filter 7.

The present invention is of course not limited to the exemplary embodiment shown.

In particular a process air channel extension z need not run vertically downward in the region of the cleaning device 9. In principle a different angle of inclination of the process air channel 5 is also possible, even horizontal orientation of the process air channel. The critical factor is solely that the fluff filter 7 runs obliquely, and not horizontally with its planar extension in the surrounding compartment. An angle $\alpha$ to the fluff filter extension of the surface of the fluff filter 7 relative to the process air channel extension z and/or relative to the perpendicular in the compartment around the fluff filter 7 is preferably selected, such that a cleaning liquid sprayed onto the fluff filter surface of the fluff filter 7 in the upper region can readily drain across the fluff filter surface to the outflow chamber 12 arranged below. Gravitational force is in particular exploited, which effects drainage of the cleaning liquid W via the fluff filter surface of the fluff filter 7 from the nozzle(s) 16 to the fluff filter-outflow chamber(s) 12. Support for the gravitational effect is in particular in the case of close-meshed fluff filters by the process air L forced against or sucked through the fluff filter surface or a spray pressure of the cleaning liquid by means of the nozzles 16, 19.

Instead of feeding of the cleaning liquid W from the liquid container 8 a cleaning liquid can also be fed from a different liquid container or a fresh water line. Also, the soiled cleaning liquid W* need not necessarily be directed into liquid container 8, which serves to accommodate condensate water. The soiled cleaning liquid W* can alternatively also be directed into a separate liquid container or allowed to exit via an outlet directly from the laundry dryer 1.

The cleaning device 9 can in particular comprise a one-piece fluff filter housing 10, which is arranged in an inclined manner in the compartment. Also capable of implementation is a preferable variant outlined in FIG. 1, in which the process air channel 5 has obliquely angled ends to the pipe wall, and engages from two sides in corresponding recesses of the cleaning device 9 or of its fluff filter housing 10.

The channel 13 for removal of the soiled cleaning liquid W* can also be employed as an independent component, for example used as a hose in an outlet opening of the outflow chamber 12.

The exemplary sequence of the components of the tumble dryer used as a laundry dryer 1 can also have a different order. In particular such a fluff filter 7 does not need to be arranged directly behind the drum housing 2 in the process air channel 5, but can also be arranged at any desired point in the process air channel 5. The use of such a fluff filter 7 in a process air channel designed in another manner is also possible, for example in an air feed channel or in an air extraction channel, which lead to an exterior of the laundry dryer 1 and are not embodied as a closed process air circuit.

What is claimed:

1. A method for cleaning a filter of a laundry dryer, having a filter for the filtering-out of fluff from a process air stream flowing through a vertically oriented process air channel of the laundry dryer, and having a cleaning device for cleaning of the filter, wherein the filter is inclined at an oblique angle relative to vertical, the filter having an upstream fluff collection surface positioned upstream in the vertically oriented process air channel relative to the process air stream, the method comprising:

directing a cleaning liquid from a cleaning opening in the vertically oriented process air channel and directly bordering an upper region of the upstream fluff collection surface of the obliquely angled filter on which the fluff is collected, and guiding said cleaning liquid and said fluff, by way of said filter, to travel along the upstream fluff collection surface at said oblique angle in a gravity assisted manner, to thereby clean the filter.

2. The method according to claim 1, wherein the cleaning liquid is supplied without pressurization.

3. A laundry dryer, comprising:

a vertically oriented process air channel adapted to flow a process air stream during a laundry drying operation;

a fluff filter disposed in the vertically oriented process air channel, the fluff filter having an oblique angle with respect to vertical and having an upstream top surface to collect fluff, the upstream top surface being positioned upstream in the vertically oriented process air channel relative to the process air stream; and a cleaning opening in the vertically oriented process air channel and adjacent to an upper region of the fluff filter, the cleaning opening having a lower surface that is flush with or at a small angle relative to the upstream surface of the fluff filter, to direct liquid and fluff along the upstream top surface from a top region to a bottom region of the filter, with the assistance of gravity, to clean fluff from the filter.

4. The dryer of claim 3, wherein the cleaning opening is directly adjacent to a top of the fluff filter.

5. The dryer of claim 3, wherein the cleaning opening is substantially flush with a filter surface of the fluff filter.

6. The dryer of claim 3, wherein the cleaning opening is at an acute angle with respect to the fluff filter.

7. The dryer of claim 3, wherein the cleaning opening is configured so that the liquid is supplied without pressurization.

8. A laundry dryer, comprising:

a vertically oriented process air channel adapted to flow a process air stream during a laundry drying operation;

a fluff filter disposed in the vertically oriented process air channel and adapted to filter out fluff from the process air stream flowing though the vertically oriented process air channel of the laundry dryer, the fluff filter having an upstream filter surface positioned upstream in the vertically oriented process air channel relative to the process air stream, the upstream filter surface being inclined at an angle relative to vertical and adapted to collect fluff; and a cleaning device adjacent a top portion of the upstream filter surface and positioned relative to the fluff filter to direct cleaning liquid into the vertically oriented process air channel and over the upstream surface of the fluff filter such that the fluff filter guides the cleaning liquid and fluff to travel from an upper region of the upstream filter surface to a lower region of the upstream filter surface along said oblique angle, with the aid of gravity, to remove fluff from the filter.

9. The laundry dryer of claim 8, wherein the vertically oriented process air channel is essentially vertical in a region of the filter and a direction of flow of the process air in the vertically oriented process air channel is largely from top to bottom.

10. The laundry dryer of claim 8, wherein the cleaning device forms a part of an end plate.

11. The laundry dryer of claim 10, wherein the end plate comprises a front end plate.

12. The cleaning device of claim 8, wherein the filter is integral with the cleaning device.

13. The laundry dryer of claim 8, wherein the cleaning device includes a cleaning opening having a lower surface that is substantially flush with or at an acute angle relative to the upstream surface and opening into the vertically oriented process air channel.

14. The laundry dryer of claim 13, wherein the cleaning opening leads to a liquid line of the cleaning device.

15. The laundry dryer of claim 14, wherein the liquid line ends in an inflow chamber, which is partially separated from the cleaning opening via a partition.

16. The laundry dryer of claim 15, wherein a through-opening for the drainage of residual water leads through the partition.

17. The laundry dryer of claim 13, wherein the cleaning opening comprises a nozzle.

18. The laundry dryer of claim 13, wherein the cleaning opening is flush to the filter surface of the filter.

19. The laundry dryer of claim 13, wherein the cleaning opening is at an angle relative to the filter surface of the filter.

20. The laundry dryer of claim 13, further comprising a drain channel proximate the lower region for drainage of cleaning liquid directed over the filter.

21. The laundry dryer of claim 20, wherein a section of the drain channel bordering the filter is integrated with the filter.

22. The laundry dryer of claim 20, wherein a filter surface of the filter is at a higher level or flush in a transitional area to the drain channel.

23. The dryer of claim 13, wherein the cleaning opening directly borders the upper region of the fluff filter.

24. The laundry dryer of claim 13, wherein the cleaning opening directly borders the upper region of the upstream filter surface.

25. The laundry dryer of claim 13, wherein the cleaning opening is integrated into a fluff filter housing or a fluff filter frame.

26. The laundry dryer of claim 8, wherein the cleaning device includes a cleaning opening having a lower surface that is provided at an acute angle relative to the upstream surface and opening into the vertically oriented process air channel, the acute angle being less than 5 degrees.

27. The laundry dryer of claim 8, further comprising a control device to automatically direct said cleaning liquid on the upstream filter surface.

28. The laundry dryer of claim 8, wherein the upstream filter surface comprises a close-mesh fluff filter over which the washing liquid and fluff are adapted to travel.

29. The laundry dryer of claim 8, wherein the cleaning device is configured to direct the cleaning liquid over the upstream surface of the fluff filter without pressurizing the cleaning liquid.

30. A laundry dryer, comprising:

a vertically oriented process air channel adapted to flow a process air stream during a laundry drying operation;

a fluff filter disposed in the vertically oriented process air channel and adapted to filter out fluff from the process air stream flowing though the vertically oriented process air channel of the laundry dryer, the filter having an upstream filter surface that is inclined at an oblique angle relative to vertical and the process air stream, the upstream filter surface being adapted to collect fluff and positioned upstream in the vertically oriented process air channel relative to the process air stream; and a cleaning device oriented and positioned relative to the filter to direct cleaning liquid into said vertically oriented process air channel and over the upstream surface of the fluff filter and/or said process air stream over the upstream surface of the fluff filter such that the upstream filter surface guides fluff to travel from an upper region of the upstream filter surface to a lower region of the upstream filter surface along said oblique angle, with the aid of gravity, to remove fluff from the filter.

31. The laundry dryer of claim 30, wherein cleaning device is configured to direct the cleaning liquid over the upstream surface of the fluff filter without pressurizing the cleaning liquid.

* * * * *